US005981133A

United States Patent [19]

Miyamoto et al.

[11] Patent Number: 5,981,133

[45] Date of Patent: Nov. 9, 1999

[54] LIQUID DEVELOPER AND IMAGE FORMING APPARATUS

[75] Inventors: Hidetoshi Miyamoto, Takatsuki; Toshimitsu Fujiwara, Osaka; Shuji Iino, Ostu; Masaharu Kanazawa, Suita; Seishi Ojima, Takatsuki, all of Japan

[73] Assignee: Minolta Co., Ltd., Osaka, Japan

[21] Appl. No.: 09/053,020

[22] Filed: Apr. 1, 1998

[30] Foreign Application Priority Data

Apr. 4, 1997 [JP] Japan ..... 9-085431

[51] Int. Cl.[6] ..... G03G 9/13

[52] U.S. Cl. ..... 430/114; 430/112; 430/116

[58] Field of Search ..... 430/114, 116, 430/112

[56] References Cited

U.S. PATENT DOCUMENTS 4,254,201 3/1981 Sawai et al. ..... 430/114

FOREIGN PATENT DOCUMENTS 7-181749 7/1995 Japan .

OTHER PUBLICATIONS

Chemical Abtracts 123:241992, 1995.

Diamond, Arthur S. (editor) Handbook of Imaging Materials. New York: Marcel–Dekker, Inc. pp. 227–247, 1991.

*Primary Examiner*—Christopher D. Rodee

*Attorney, Agent, or Firm*—Burns, Doane, Swecker & Mathis, LLP

[57] ABSTRACT

A liquid developer having a superior sedimentation characteristic and floating characteristic and an image forming apparatus using said liquid developer, wherein said liquid developer comprising toner dispersed in liquid medium and the difference in specific gravity between said toner and said liquid medium is at or lower than a prescribed level.

22 Claims, 1 Drawing Sheet

LIQUID DEVELOPER AND IMAGE FORMING APPARATUS

This application is based on application No. 9-85431 filed in Japan, the contents of which is hereby incorporated by reference.

BACKGROUND OF THE INVENTION

1. Field of the Invention

The present invention pertains to a liquid developer for electrophotography that is used to develop an electrostatic latent image in an image forming apparatus such as a copying machine or printer using the electrophotographic method, as well as to an image forming apparatus.

2. Description of the Related Art

Image formation using the electrophotographic method is divided into a dry developing method and a wet developing method.

In dry development, development is performed using toner only or using toner mixed with a carrier. Dry toner comprises mainly a coloring agent, such as a pigment, and a binder resin, to which a charge controller, plasticizer, surface lubricant, etc., are added by means of internal dispersion, or adherence or fixation to the toner particle surfaces. In dry development, toner is charged by means of frictional charging, and is supplied for the purpose of development by means of the electrostatic force of the latent image.

Particles of dry toner that are used in dry development start to float in the air if they are made smaller than a certain size, so they cannot be made too fine. Therefore, relatively large particles, up to approximately 10 micron in average particle diameter, are used. The dry method thus has the technological limitation that the development resolution is not very high due to the relatively large size of the toner particles, as described above.

On the other hand, in wet development, a developer comprising a binder resin on which toner including a coloring agent is dispersed, or a developer comprising a resin that is colored itself, have been proposed. Where necessary, developers on which a charge controller, dispersion promoting agent, etc., are also dispersed have been proposed as well.

Charging of these types of toners is thought to occur based on ion adsorption by the charge controller, and the charged toner is supplied for development based on the principle of electrophoresis.

The toner used in the wet method has the technological advantage over dry method toner that toner particles may be made very small because they will not escape into the air. Therefore, when supplied to an image forming apparatus, said toner offers the advantages that a high-resolution image can be obtained and that fusing of the toner image is easy.

On the other hand, a liquid developer entails the problems of sedimentation of the toner particles in the carrier solution and of imperfect dispersion, which do not exist with dry developers. The inventors of the present invention have focused their attention on this point.

This sedimentation problem is quite significant with regard to liquid developers that have a resin ingredient and include particles of toner of a certain size or larger, i.e., so-called binder toner.

OBJECTS AND SUMMARY

The object of the present invention is to provide a liquid developer for electrophotography which permits a development speed that is required in practical use, and in which (i) the toner does not easily sediment, and (ii) even when sedimented, the toner can be easily re-dispersed.

Another object of the present invention is to provide an image forming apparatus using which such problems as inconsistency in image darkness, image noise due to the blocking by sedimented toner, and reduced resolution do not occur, because a development speed required in practical use may be obtained and the toner does not easily sediment.

In order to solve the problems described above, the applicant of the present invention found, through extensive research, that for the most desirable effects in practical use, it is necessary to make the volume average particle diameter of the toner particles approximately 0.5 micron or larger in order to obtain a development speed that is required inpractical use, and the difference in specific gravity between the toner and the carrier liquid should be reduced to the extent possible in order to prevent the toner particles from sedimenting, but the difference in specific gravity should be at a prescribed level because if the toner particles were made too small, the toner particles would float up to the surface and cause a problem.

Based on these findings, the present invention provides a liquid developer for electrophotography comprising a liquid medium and toner dispersed in said liquid medium and an image forming apparatus that uses said developer, wherein the difference in specific gravity between said toner and said liquid medium is at a prescribed level.

It also provides a liquid developer for electrophotography comprising a liquid medium and toner dispersed in said liquid medium and an image forming apparatus that uses said developer, wherein the air bubble ratio of said toner particles is within a prescribed range in order for the difference in specific gravity between said toner and said liquid medium to be at a prescribed level.

It also provides a liquid developer for electrophotography comprising a liquid medium and toner dispersed in said liquid medium and an image forming apparatus that uses said developer, wherein the difference in specific gravity between said toner and said liquid medium is at a prescribed level and the volume average particle diameter (d50) of said toner particles is 0.5–5 micron.

It also provides a liquid developer for electrophotography comprising a liquid medium and toner dispersed in said liquid medium and an image forming apparatus that uses said developer, wherein said toner particles have a prescribed air bubble ratio and their volume average particle diameter (d50) is 0.5–5 micron.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Figure 1:
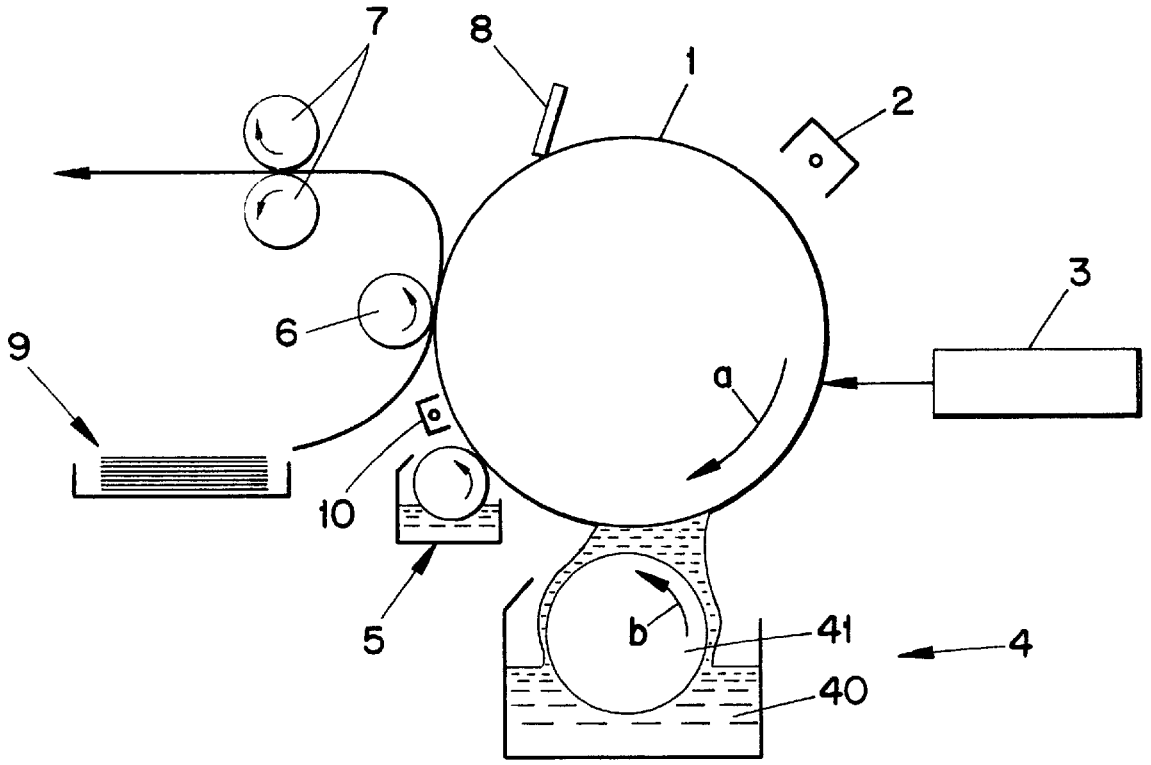
FIG. 1 shows an image forming apparatus in which the present invention is applied.

A preferred embodiment of the present invention comprises a liquid developer supplied to an image forming apparatus using the electrophotographic process and an image forming apparatus that uses said developer, wherein said liquid developer for electrophotography includes toner dispersed in a liquid medium, and the difference in specific gravity between said toner and said liquid medium is 0.45 or lower.

The present invention is obtained by selecting, in order to obtain the preferred level of sedimentation, the materials and physical properties for the liquid medium and toner from the perspective of specific gravity, which has never before been taken into consideration in such selection.

Another preferred embodiment of the present invention comprises a liquid developer comprising toner dispersed in a liquid medium and an image forming apparatus that uses said developer, wherein in said liquid developer, the air bubble ratio of the toner particle is between 2% and 20%, and more preferably, between 8% and 17%, in order to ensure that the difference in specific gravity between the toner and the liquid medium is at a prescribed level.

The third preferred embodiment of the present invention comprises a liquid developer for electrophotography comprising toner dispersed in a liquid medium and an image forming apparatus that uses said developer, wherein the difference in specific gravity between said toner and said liquid medium is 0.45 or less and the volume average particle diameter (d50) is somewhere between 0.5 micron and 5 micron.

The fourth preferred embodiment of the present invention comprises a liquid developer comprising toner dispersed in a carrier solution and an image forming apparatus that uses said developer, wherein the air bubble ratio of the toner particles is between 2% and 20%, and more preferably between 8% and 17%, and the volume average particle diameter (d50) of said toner is somewhere between 0.5 micron and 5 micron.

Said toners in the liquid developers for electrophotography pertaining to the preferred embodiments of the present invention include those that comprise a binder resin including a coloring agent such as a pigment and those that, where the resin itself is colored, comprise the resin granulated into fine particles.

A desired specific gravity may be obtained by changing the type of resin used and the amount added.

Using the liquid developer of any of the preferred embodiments of the present invention, in addition to the effect of appropriate sedimentation that is obtained by making the specific gravity or air bubble ratio a prescribed level, faster development as well as high resolution can be obtained by making the volume average particle diameter (d50) be somewhere between 0.5 micron and 5 micron.

In the present invention, it is preferred, in order to keep the difference in specific gravity between the liquid medium and the toner within a desired range, that a resin ingredient be added to the toner and that prescribed air bubbles be formed in said resin particles.

By forming air bubbles in this way, even where the specific gravity of the resin itself does not meet the preferred level of the present invention, by forming appropriate air bubbles, the desired levels of sedimentation and suspension may be obtained. Therefore, the range of resins that may be selected increases, and by selecting a resin based on factors other than sedimentation and suspension characteristics, i.e., bonding and charging characteristics, for example, and forming desired air bubbles in the selected resin particles, a desired level of sedimentation is also obtained, which leads to a desirable speed of development.

If the difference in specific gravity between the carrier solution and the toner decreases, the sedimentation speed of the toner particles slows down, and when the toner has become sedimented, it is easier to disperse the toner particles within the solution again. In addition, because the pressure from their own weight on the toner particles that have sedimented decreases, the toner sediment does not become packed down, which makes it harder to cause blocking of the sedimented toner. When the glass transition temperature of the toner binder resin is low, blocking does not easily occur. The glass transition temperature of the binder resin can be lowered to this extent, which reduces the heat transfer temperature regarding transfer of the toner image onto the recording medium, leading to reduced heat damage and deterioration of the components of the image forming apparatus.

Further, because the amount of resin contained in one toner particle is small, the enlargement of a dot when the toner particle is pressed down during fusing is reduced, which leads to higher resolution. Moreover, because the amount of resin contained in one toner particle is small, the particle's heat capacity is small, and therefore, the speed of heat transfer increases and heat transfer of an image at a lower temperature becomes possible.

In view of these advantages, it is preferred that the air bubble ratio be 2% or more. If the air bubble ratio is lower than 2%, the effect of having air bubbles is not obtained to a satisfactory degree.

On the other hand, if the air bubble ratio is large, the toner particles could be destroyed due to mechanical stress. Preferably, therefore, the air bubble ratio will be 20% or lower, and mechanical strength of the toner be increased through the inclusion of a resin ingredient. If the air bubble ratio becomes higher than 20%, the toner particles are easily destroyed when subjected to pressure at locations such as between the cleaning blade and the electrostatic latent image carrier or inside the pump of the developing device. If they are destroyed, the amount of smaller toner particles increases, which adversely affects the development and transfer characteristics.

With regard to the distribution of the volume average toner particle diameter (d50), it is preferred that 80% of the total volume of the toner be within the ±1 micron range of the volume average particle diameter (d50). More preferably, the range should be ±0.5 micron of the volume average particle diameter (d50). By having the percentage total volume of the toner fall within this range, a stable, high quality liquid developer may be obtained.

The air bubble ratio in the present invention can be calculated from the apparent specific gravity of dry toner particles measured by means of the immersion method using a picnometer, for example, and from the true specific gravity of the toner that is obtained by melting the resin ingredient through heating and crushing the resulting product.

In other words, the air bubble ratio is defined by calculation using the following equation based on the apparent specific gravity (D1) of dry toner particles measured by means of the immersion method using a picnometer and the true specific gravity (D0) of the toner that is obtained by melting the resin ingredient through heating and crushing the resulting product.

$$\text{Air bubble ratio } (\%) = [1-(D1/D0)] \times 100$$

The volume average particle diameter (d50) may be measured using a laser diffraction particle size distribution measuring device, for example. For such a laser diffraction particle size distribution measuring device, SALD-1100 (manufactured by Shimadzu Corporation) may be used, for example.

The liquid developer containing toner particles having air bubbles inside them, a preferred embodiment of the present invention, is manufactured using the following process, as one example.

Toner particles are manufactured using the dry or wet manufacturing technique. The dry manufacturing technique includes dry crushing and spray drying, while the wet manufacturing technique includes crushing in solution (wet crushing), suspension polymerization, emulsion polymerization, nonaqueous dispersion polymerization, seed polymerization and emulsion dispersion granulation. It is preferred to use emulsion dispersion granulation or spray drying, in particular, because these methods may be used for a wide range of resins, and because, using these methods, it is easy to adjust the molecular amount of the binder resin, the resin blends well and it is easy to control the toner particle size distribution. It is also acceptable if the emulsion dispersion granulation or spray drying are combined with dry crushing or wet crushing.

In order to obtain toner particles having air bubbles inside using dry crushing or wet crushing, rough particles that have air bubbles inside, such as sponge-like or hollow rough particles, are first manufactured, and these particles are then crushed into finer particles by means of dry or wet crushing so that toner particles having air bubbles inside may be obtained.

Rough particles having air bubbles inside may be obtained by using a substance that foams when heated, such as sodium hydrogencarbonate, and a low-boiling point volatile solvent such as a volatile organic solvent such as acetone, methylene chloride or toluene, and by applying in the dry crushing or spray drying an evaporation or vacuum evaporation technique in which a liquid incompatible with the binder resin, such as water, is rapidly heated to a temperature exceeding its boiling point.

In this case, the control of the air bubble ratio of the toner particles is performed by controlling the air bubble ratio of the rough particles. The air bubble ratio of the rough particles can be regulated by adjusting the amounts of the foaming substance, the volatile solvent and the liquid incompatible with the binder resin, for example.

Emulsion dispersion granulation is a method to manufacture fine toner particles by dispersing a resin solution created by dissolving a binder resin in a non-water-soluble organic solvent and adding desired additives such as a coloring agent and charge controller if necessary, in a water-based dispersion liquid to form an O/W-type (oil in water) emulsion, and by heating, while stirring it, the O/W-type emulsion to evaporate the organic solvent and deposit the binder resin. A foaming substance, volatile solvent and liquid incompatible with the binder resin may be used in this method as well. However, even where these are not used, the air bubble ratio may be controlled by adjusting the evaporation speed of the organic solvent via regulation of the temperature.

Spray drying is a method to manufacture fine toner particles by injecting from a nozzle and heating a resin solution created by dissolving a binder resin in a non-water-soluble organic solvent, in which solution a coloring agent and charge controller are dispersed if necessary to evaporate the organic solvent.

Where toner particles are manufactured using suspension polymerization, emulsion polymerization, nonaqueous dispersion polymerization or seed polymerization, desired additives such as a coloring agent and charge controller should be added where necessary at the time of polymerization before further processing continues.

The toner particles obtained in any of the methods described above, which have air bubbles inside, are washed and dried, and are then dispersed in an electrically insulated carrier solution using a high shearing dispersing device, homogenizer or ultrasonic dispersing device. Where necessary, additives such as a known charge controller, dispersion agent and fusing agent are added before the toner particles are dispersed using one of said methods.

In a liquid developer for electrophotograpy pertaining to a preferred embodiment of the present invention, the toner concentration (the ratio of the total weight of toner to the total weight of the liquid developer) is appropriate at one to 90 percent by weight. In order to reduce the amount of liquid developer used for development and allow easy handling, it is preferred that the concentration of non-volatile ingredients such as toner be two to 50 percent by weight.

For the coloring agent, any known pigment or dye such as carbon black or phthalocyanine may be used. It is preferred that the amount of the coloring agent added to the resin be 5 to 20 parts per 100 parts of resin. It is also acceptable if the resin itself is colored.

The binder resin that comprises toner particles should be, without limitation, any resin that has thermoplasticity and does not become essentially dissolved in the carrier liquid. These resins include, for example, thermoplastic saturated polyester resin, styrene-acryl copolymer resin, styrene-acryl modified polyester resin, polyolefin copolymer resin (ethylene copolymers in particular), epoxy resin, rosin modified phenol resin, and rosin modified maleic acid resin, and these may be used individually or in combination. Further, where necessary, a resin such as paraffin wax or polyolefin may be blended in to comprise 20 percent or less by weight as a surface lubricant.

It is particularly preferred that an amorphous polyester resin be used, because an amorphous polyester resin not only allows its physical properties such as its thermal property to vary over a wide range, but also because it allows beautiful colors due to its superior transmittency when developing color images, and because the resin film created after fusion is strong and adheres well to the recording medium such as paper due to its good extensibility and viscosity.

Specifically, a polyester resin means a resin produced through the polycondensation of a polyhydric alcohol and a polyhydric basic acid (polyhydric carboxylic acid).

Polyhydric alcohols include without limitation alkylene glycols (aliphatic glycols) such as ethylene glycol, diethylene glycol, triethylene glycol, propylene glycol such as 1,2-propylene glycol, dipropylene glycol, butanediol such as 1,4-butanediol, neopenthyl glycol, hexanediol such as 1,6-hexanediol, and the alkylene oxide added products thereof, bisphenols such as bisphenol A and hydrogen-added bisphenol, and the alkylene oxide added products thereof, i.e., phelic glycols, alicyclic and aromatic diols such as monocylclic or polycyclic diols, and triols such as glycerine and trimethyrol propane. These may be used individually or in combinations of two or more.

Neopenthyl glycol and bisphenol A to which 2 to 3 moles of an alkylene oxide are added are particularly suited for the toner binder resin in a liquid developer due to the solubility and stability of the polyester resin, their product, and are also preferred due to their low cost. For the alkylene oxide, ethylene oxide or propylene oxide may be used.

For the polyhydric basic acid (polyhydric carboxylic acid), malonic acid, succinic acid, adipic acid, azelaic acid, sebacic acid, fumaric acid, maleic acid, itaconic acid, phthalic acid and the modified acids thereof (hexahydrophthalic anhydride, for example), saturated or unsaturated dihydric basic acid such as isophthalic acid or telephthalic acid, trifunctional or higher saturated polyhydric basic acid such as trimellitic acid, and pyromellitic acid or methylnadic acid and the acid anhydrides and lower alkylesters thereof may be used without limitation. These may be used individually or in combinations of two or more.

Isophthalic acid and telephthalic acid are particularly suitable for the toner binder resin in a liquid developer due to the solubility and stability of the polyester resin, their product, and are also preferred due to their low cost.

For polycondensation, the public domain polycondensation process may be generally employed. While this depends on the type of the raw material monomer, the process generally takes place in an approximately 150 to 300 deg C. environment. Further, various conditions may be employed including the use of an inert gas for the ambient gas, the use of various solvents and maintenance of normal pressure or reduced pressure inside the reactor. Moreover, an esterification catalyst may be used to promote reaction. For the esterification medium, a metal organic compound such as tetrabutyl zirconate, zirconium naphtenate, tetrabutyl titanate, tetraoxthyl titanate, or 3/1 oxalate/sodium acetate may be used, provided that the metallic organic compound does not color the product ester. Further, alkylphosphate or arylphosphate may be used as a catalyst or as a color adjusting agent.

For the liquid medium, a liquid having a resistance that does not interfere with the electrostatic latent image (approximately $10^{11}$ to $10^{16}$ ohm·cm) is preferred. The medium must be in liquid form during development when the temperature increases to a level exceeding the softening point of the resin to be dispersed, but its form at room temperature does not matter. Further, it is preferred that its boiling point be such that it allows quick drying after fusing. It is also preferred that the medium be a solvent with no odor or toxicity, with a relatively high flash point.

For example, aliphatic hydrocarbon, alicyclic hydrocarbon, aromatic hydrocarbon, halogenated hydrocarbon or polysiloxane may be used. From the viewpoint of odor, non-toxicity and cost, normal paraffin solvents and isoparaffin solvents are preferred in particular. Specifically, they include Isoper G, Isoper H, Isoper L and Isoper K (manufactured by Exxon Chemical) Shelzol 71 (manufactured by Shell Petrochemical), and IP Solvent 1620 and IP Solvent 2028 (manufactured by Idemitsu Petrochemical). In addition, waxes and paraffins that are solid at room temperature may be used as well. Where any of these waxes or paraffins that are solid at room temperature is used, it should be heated before being used as a liquid developer so that it will reconvert to liquid form.

The charge controller is essentially solvated or dissolved in the carrier liquid, and is used for the purpose of affecting the amount of charge attracted by the toner particles. Specifically, examples include without limitation the substances explained in paragraphs (1), (2) and (3) below.

(1) Polymers or copolymers soluble in the carrier liquid, which include a monomer containing nitrogen as an ingredient. Specifically, they are polymers that contain any of (meth)acrylates having an aliph amino group, complex cyclic vinyl monomers containing nitrogen, N-vinyl displaced cyclic amide monomers, (meth)acrylic amides, aromatic displaced ethylene monomers having a nitrogen group, or vinyl ether monomers containing nitrogen, and in particular, copolymers soluble in a hydrocarbonic carrier liquid, which are produced through copolymerization of any of said polymers with a monomer such as hexyl (meth) acrylate, cyclohexcyl (meth)acrylate, 2-ethylhexyl (meth) acrylate, oxthyl (meth)acrylate, nonyl (meth)acrylate, decyl (meth)acrylate, dodecyl (meth)acrylate, lauryl (meth) acrylate, stearyl (meth)acrylate, vinyl laurate, vinyl stearate, benzyl (meth)acrylate or phenyl (meth)acrylate.

(2) Ionic surfactant such as metallic salts of fatty acids such as naphthenic acid, octanic acid, oleic acid and stearic acid, metallic salt of dialkylsulfosuccinic acid, metallic salt of alkyl sulfonic acid, calcium salt or barium salt of alkylbenzen sulfonic acid, metallic salts of aromatic carboxylic acid or sulfonic acid, petroleum sulfonate (barium salt or calcium salt), basic petroleum sulfonate (barium salt or calcium salt), long-chain alkylsalycilate, long-chain alkylphosphonate, long-chain alkylphenate, basic phenate, metallic salt of alkylphosphoric ester, metallic salts of abietic acid, and hydrogen-added abietic acid.

(3) Amphoteric surfactant such as lecithin and natural fats and oils such as linseed oil.

The charge controllers listed in paragraphs (1), (2) and (3) above may be used individually or in combinations of two or more.

Among the charge controllers listed above, in paragraph (1), random or graft copolymers of N-vinyl pyrolidone or dimethyl aminoethyl methacrylate and ester methacrylate having an alkyl group with 10 to 20 nitrogen atoms are preferred. In addition, such copolymers that contain 0.1 to 30 percent by weight, and more particularly, 0.5 to 20 percent by weight of a monomer ingredient containing nitrogen, are preferred. In paragraph (2), petroleum sulfonate (barium salt or calcium salt) and basic petroleum sulfonate (barium salt or calcium salt) are preferred. In (3), lecithin is preferred.

In addition, where necessary, a dispersion promoting agent comprising any of the polymers of acrylic monomers having a long-chain alkyl group such as 2-ethylhexyl (meth) acrylate, lauryl (meth)acrylate and stearyl (meth)acrylate, or copolymers (random copolymers, graft copolymers, block copolymers, etc.) of any of said polymers and other monomers (styrene, (meth)acrylic acid, methyl (meth)acrylate, ethyl (meth)acrylate, propyl ester (meth)acrylate, etc.), or rosin or rosin modified resin may be used as well.

It is preferred that a charge controller be added in the ratio of approximately 0.1 to 5.0 percent by weight of the carrier liquid or approximately 1.0 to 80 percent by weight of the toner. The more preferred amount is approximately 5 to 70 percent by weight of the toner.

The present invention is explained below in specific terms with reference to embodiments, which the present invention is not limited to. In the embodiments explained below, "parts" means "parts by weight" unless otherwise defined.

Further, in the embodiments explained below, numerical average molecular weight (Mn) and weight average molecular weight (Mw) of the binder resin were obtained using gel permeation chromatography (GPC). Gel permeation chromatography was performed using a TRI ROTAR-V high-speed liquid chromatograph pump (manufactured by Nippon Bunko K.K.), a UVIDEC-100-V UV spectrometer (manufactured by Nippon Bunko K.K.) and a Shodex GPC A-803 having a 50 cm-long column (manufactured by Showa Denko K.K.). The weight average molecular weight (Mw) was sought from the chromatography result as a polystyrene converted weight average molecular weight by calculating the molecular weight of the test sample using polystyrene as a reference substance. The number average molecular weight (Mn) was also sought from the chromatography result in the same way. For the test sample, 0.05 g of the binder resin was dissolved in 20 ml of tetrahydrofuran (THF).

The acid value was measured using the conditions of JIS K5400.

The volume average particle diameter (d50) was measured using SALD-1100 laser diffraction particle size distribution measuring device (manufactured by Shimadzu Corporation). The air bubble ratio inside a particle was calculated using the following equation from the apparent specific gravity of dry toner particles (D1) measured by means of the immersion method using a picnometer and from the true specific gravity of the toner (D0) obtained by melting the resin ingredient via heating and crushing the resulting product.

$$\text{Air bubble ratio } (\%)=[1\times(D1/D0)]\times 100$$

Manufacture of Toner Particles (1) Manufacture of Toner Particles 1

Emulsion Dispersion Granulation

A mixture comprising 100 parts of amorphous low molecular weight polyester resin (acid value=15.0 mgKOH/g, Mn=2,700, Mw=8,500) and 20 parts of carbon black Morgal L (manufactured by Cabot) was dissolved and dispersed in 500 parts of toluene to obtain a colored resin solution. 1,000 ml of this resin solution was dispersed and emulsified well in 2,000 ml aqueous solution of carboxymethyl cellose (CMC) 1.5%/Lauryl sodium sulfate 0.5% via high-velocity rotation until 3 micron-diameter droplets were attained. The toluene was then removed at 60 deg C. under reduced pressure. Solids and liquids were separated using a centrifuge. The solid product was washed and dried, whereupon toner particles 1 having a 1.45 micron volume average particle diameter were obtained. When a cross-section of this toner particle was observed using a transmission electronic microscope (TEM), multiple air bubbles were seen. When the air bubble ratio of these internal air bubbles was measured using the method described above, it was found to be 8.43%. The specific gravity of said toner was 1.117.

(2) Manufacture of Toner Particles 2

Spray Drying

A mixture comprising 100 parts of amorphous low molecular weight polyester resin (acid value=15.0 mgKOH/g, Mn=2,700, Mw=8,500) and 20 parts of carbon black Morgal L (manufactured by Cabot) was dissolved and dispersed in 1,000 parts of methylene chloride to obtain a colored resin solution. This resin solution was spray-dried at 65 deg C. using Disper Coat (manufactured by Nissei Engineering Co., Ltd.), whereupon toner particles 2 having a 1.50 micron volume average particle diameter were obtained. When a cross-section of this toner particle was observed using a TEM, multiple air bubbles were seen. When the air bubble ratio of these internal air bubbles was measured using the method described above, it was found to be 17.37%. The specific gravity of said toner was 1.008.

(3) Manufacture of Toner Particles 3

Dry Crushing

A mixture comprising 50 g of amorphous low molecular weight polyester resin (acid value=15.0 mgKOH/g, Mn=2,700, Mw=8,500) and 50 g of carbon black Morgal L (manufactured by Cabot) was mixed at 180 deg C. for four hours using a kneader having three rolls to obtain a high-concentration pigment mixture. This high-concentration pigment mixture was diluted with the same polyester resin using a kneader, and a colored resin mixture containing 20 percent carbon black by weight was finally obtained. This mixture was cooled and crushed roughly using a cutter mill. The crushed mixture was then further crushed into fine particles using Jet Mill (Manufactured by Nippon Neumatic Industry Co., Ltd.), whereupon colored particles of an approximately 10 micron average particle diameter were obtained 30 g of said colored particles was mixed with 70 g of IP Solvent 1620 solution containing 0.7 percent Sulfol Ba-30N by weight. This mixture was wet-ground by means of a sand grinder (manufactured by Igarashi Kikai Seizo Co., Ltd.) using 1 mm diameter glass beads (150 cc) in a ⅛ gallon vessel equipped with a water jacket at a 2,000 rpm disk rotation for 15 hours. In this way, a high-concentration liquid developer containing toner particles 3 having a 1.45 micrometer volume average particle diameter was obtained. When the cross-section of this toner particle 3 was observed using a TEM, no air bubbles were observed. The air bubble ratio measured by means of the method described above was 0.02%. The specific gravity was 1.220.

(4) Manufacture of Toner Particles 4

A mixture comprising 100 parts of amorphous low molecular weight polyester resin (acid value=15.0 mgKOH/g, Mn=2,700, Mw=8,500) and 20 parts of carbon black Morgal L (manufactured by Cabot) was dissolved and dispersed well in 1,000 parts of methylene chloride to obtain a colored resin solution. This resin solution was spray-dried at a 58 deg C. drying temperature using Disper Coat (manufactured by Nissei Engineering Co., Ltd.), whereupon colored toner particles 4 having a 1.40 micron average particle diameter were obtained. When the cross-section of this toner particle was observed using a TEM, multiple air bubbles were seen. When the air bubble ratio of these internal air bubbles was measured using the method described above, it was found to be 2.1%. The specific gravity of said toner was 1.194.

(5) Manufacture of Toner Particles 5

A mixture comprising 100 parts of amorphous low molecular weight polyester resin (acid value=15.0 mgKOH/g, Mn=2,700, Mw=8,500) and 20 parts of carbon black Morgal L (manufactured by Cabot) was dissolved and dispersed well in 1,000 parts of methylene chloride to obtain a colored resin solution. This resin solution was spray-dried at 75 deg C. drying temperature using Disper Coat (manufactured by Nissei Engineering Co., Ltd.), whereupon colored toner particles 5 having a 1.60 micron average particle diameter were obtained. When the cross-section of this toner particle was observed using a TEM, multiple air bubbles were seen. When the air bubble ratio of these internal air bubbles was measured using the method described above, it was found to be 20.1%. The specific gravity of said toner was 0.975.

(6) Manufacture of Toner Particles 6

A mixture comprising 100 parts of amorphous low molecular weight polyester resin (acid value=15.0 mgKOH/g, Mn=2,700, Mw=8,500) and 20 parts of carbon black Morgal L (manufactured by Cabot) was dissolved and dispersed well in 1,000 parts of methylene chloride to obtain a colored resin solution. This resin solution was spray-dried at a 90 deg C. drying temperature using Disper Coat (manufactured by Nissei Engineering Co., Ltd.), whereupon colored toner particles 6 having a 1.63 micron average particle diameter were obtained. When the cross-section of this toner particle was observed using a TEM, multiple air bubbles were seen. When the air bubble ratio of these internal air bubbles was measured using the method described above, it was found to be 25.1%. The specific gravity of said toner was 0.914.

Manufacture of Liquid Developer (1) Manufacture of Liquid Developer 1

Embodiment 1

30 g of toner particles 1 was mixed with 70 g of IP Solvent 1620 solution containing 0.7 percent petroleum barium salt sulfonate Sulfol Ba-30N (manufactured by Matsumura Petroleum Research Institute) by weight, and were dispersed in said solution for 30 minutes using a homogenizer that rotated at 15,000 rpm, whereupon a high-concentration liquid developer was obtained.

Further, 100 parts of this high-concentration liquid developer was diluted by adding 900 parts of IP Solvent 1620 solution containing 0.7 percent Sulfol Ba-30N by weight, and was dispersed in said solution for ten minutes using T.K. Auto-Homomixer M (manufactured by Tokushu Kika Kogyo Co., Ltd.) which rotated at 12,000 rpm, whereupon liquid developer 1 comprising the toner particles and liquid medium were obtained.

The specific gravity of this liquid medium was 0.765.

(2) Manufacture of Liquid Developer 2

Embodiment 2

Toner particles 2 were used in place of toner particles 1 in the manufacturing process of liquid developer 1 described above. All other conditions used in the manufacture of liquid developer 1 were used to obtain liquid developer 2.

(3) Manufacture of Liquid Developer 3

Comparison 1

100 parts of the high-concentration liquid developer obtained in the manufacture of toner particles 3 described above was diluted by adding 900 parts of IP Solvent 1620 solution containing 0.7 percent Sulfol Ba-30N by weight, and was dispersed in said solution for ten minutes using T.K. Auto-Homomixer M (manufactured by Tokushu Kika Kogyo Co., Ltd.) which rotated at 12,000 rpm, whereupon liquid developer 3 was obtained.

(4) Manufacture of Liquid Developer 4

Embodiment 3

Toner particles 4 were used in place of toner particles 1 in the manufacturing process of liquid developer 1 described above. All other conditions used in the manufacture of liquid developer 1 were used to obtain liquid developer 4.

(5) Manufacture of Liquid Developer 5

Embodiment 4

Toner particles 5 were used in place of toner particles 1 in the manufacturing process of liquid developer 1 described above. All other conditions used in the manufacture of liquid developer 1 were used to obtain liquid developer 5.

(6) Manufacture of Liquid Developer 6

Comparison 2

Toner particles 6 were used in place of toner particles 1 in the manufacturing process of liquid developer 1 described above. All other conditions used in the manufacture of liquid developer 1 were used to obtain liquid developer 6.

Evaluation of Sedimentation Characteristic

The sedimentation characteristic of the toner particles was evaluated with regard to each of the liquid developers. The sedimentation characteristic was evaluated based on the sediment volume and re-dispersion characteristic.

The sediment volume was evaluated using the following method. The liquid developers were sampled in equal volumes and the samples were mixed thoroughly. 100 ml was then taken from each sample and placed in a 100 ml-capacity graduated cylinder. The samples in the cylinder were left for 24 hours on a horizontal surface, and the volumes of toner particles that sedimented and accumulated at the bottoms were measured.

"Toner particles that sedimented and accumulated at the bottom" were determined by visually measuring the length of the area in which the toner particles were suspended, i.e., the area excluding the area at the top that consists of liquid medium only. In other words, the better the sedimentation characteristic possessed by the developer and the less the toner accumulates at the beaker bottom, the larger said volume becomes. In practical use, a sedimentation volume of 15 ml is preferred.

The re-dispersion characteristic was evaluated using the following method. Each developer was placed in a beaker equipped with a churning blade, and while this churning blade was rotated at 200 rpm, the time necessary to uniformly disperse the toner in the beaker to a prescribed concentration was measured by means of a transmission densitometer. In other words, the concentration at which uniform dispersion was achieved was measured in advance, and the time required to recover the prescribed concentration by re-churning the developer sample whose toner sedimented in 24 hours was measured.

The results are shown in Table 1. From these results, it is seen that it is necessary for the liquid developer to have a difference of 0.45 or smaller between the specific gravity of the liquid medium and that of the toner.

Destruction of Particles

The change in the volume average particle diameter (D50) of the toner particles of the liquid developer was evaluated when continuous image output had been performed for 10,000 copies at a 25/75 B/W ratio using the image forming apparatus shown in FIG. 1, with continuous replenishment of the developer. When the change in the particle diameter was 0.5 micron or larger, the developer was deemed unacceptable.

From the results of said evaluation, if the air bubble ratio exceeds 20%, the toner particles of a liquid developer containing toner that has air bubbles inside toner particles were destroyed into very fine pieces, which consequently led to a large change in the particle diameter. The results are shown in Table 1.

TABLE 1

| | | | Sedimentation characteristic | | | Change in |
|---|---|---|---|---|---|---|
| Developer | Specific gravity | Difference in specific gravity | Sedimentation volume (ml) | Re-dispersion characteristic | Air bubble ratio (%) | partcle diameter (delta micron) |
| 1: Embodiment | 1.117 | 0.352 | 38 | 15 sec. | 8.43 | 0.12 |
| 2: Embodiment | 1.008 | 0.243 | 45 | 10 sec. | 17.37 | 0.18 |
| 3: Comparison | 1.220 | 0.455 | 10 | Did not recover | 0.02 | 0.10 |
| 4: Embodiment | 1.194 | 0.429 | 15 | 4 min. | 2.10 | 0.10 |
| 5: Embodiment | 0.975 | 0.210 | 50 | 5 sec. | 20.10 | 0.20 |
| 6: Comparison | 0.914 | 0.149 | 55 | 3 sec. | 25.10 | 0.53 |

Note:
The specific gravity of the liquid medium was 0.765. The specific gravity of each developer was measured at 25 deg C.

Using the present invention, a liquid developer for electrophotography may be provided which permits a development speed that is required in practical use, and in which the toner does not easily sediment and even when sedimented, the toner can easily re-dispersed.

The image forming apparatus mentioned above and shown in FIG. 1 will now be explained.

The image forming apparatus shown in FIG. 1 is an apparatus of the electrophotographic type provided with a photosensitive drum 1. Arranged sequentially around the periphery of photosensitive drum 1 are corotron charger 2, laser beam image exposure device 3, liquid developing device 4, squeeze roller 5, squeeze charger 10, transfer roller 6, and cleaning device 8. Adjacent to transfer roller 6 are disposed a paper supply device 9, and pair of fixing rollers 7. Developing device 4 comprises developer tank 40 in which is stored liquid developer of the above embodiments, and developing roller 41 which is disposed opposite photosensitive drum 1 so as to have a slight gap therebetween and the bottom of said roller is immersed in liquid developer.

When forming an image, photosensitive drum 1 rotates in the arrow a direction in the drawing, and the surface of the drum is uniformly charged to about −1,000 V by corotron charger 2. A laser beam emitted from exposure device 3 irradiates the surface of photosensitive drum 1 in accordance with image information so as to form an electrostatic image on said surface of the drum.

The latent image formed on the surface of photosensitive drum 1 is rendered visible by the liquid developer supplied by developing device 4. The rotational speed of photosensitive drum 1 was set at 400 mm/sec, and the rotational speed of developing roller 41 was set at 1,200 mm/sec so as to achieve a circumferential speed ratio (theta) relative to photosensitive drum 1 (i.e., theta=rotational speed of developing roller/rotational speed of photosensitive drum) of 3. Developing roller 41 was rotated in the opposite direction (i.e., arrow b direction in the drawing) to the rotational direction of the photosensitive drum.

Thereafter, the excess liquid developer adhered to photosensitive drum 1 was squeezed therefrom by squeeze roller 5 and squeeze charger 10 to form a toner image in a slightly liquid state on the surface of photosensitive drum 1. The toner image was directly rotated to the transfer position opposite transfer roller 6, and comes into contacat with a sheet transported from paper supply device 9, and is transferred to said sheet by electrostatic transfer. A voltage of +1,000 V was applied to transfer roller 6.

After the transfer sheet was separated from photosensitive drum 1, the sheet was transported to a pair of heat fixing rollers 7 which fused the toner image to the sheet via heat and pressure to complete image formation, whereupon the sheet was ejected to a discharge tray not shown in the illustration. Subsequetnly, the residual liquid developer remaining on the surface of photosensitive drum 1 was removed by cleaning device 8 in preparation for the next image formation.

When actual images were obtained using the image forming apparatus shown in FIG. 1 with the use of the developers described above as the embodiments, noise-free high-resolution images were obtained. Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A liquid developer comprising:

a liquid medium; and toner dispersed in said liquid medium, wherein the difference in specific gravity between said toner and said liquid medium is 0.45 or less and an air bubble ratio of said toner is from 2 to 20%.

2. The developer of claim 1 wherein 80% of the total volume of the toner is within the ±1 micron range of the volume average particle diameter (d50).

3. The developer of claim 1 wherein the toner comprises a resin and a coloring agent, and the coloring agent is added to the resin in an amount of 5 to 20 parts per 100 parts of the resin.

4. The developer of claim 1 wherein the liquid medium has a resistance from $10^{11}$ to $10^{16}$ ohm·cm.

5. The developer of claim 1 further comprises a copolymer of N-vinyl pyrolidone or dimethyl aminoethyl methacrylate and methacrylate having an alkyl group with 10 to 20 nitrogen atoms.

6. The developer of claim 1 further comprising a charge controller which is added in the ratio of approximately 0.1 to 5.0 percent by weight of the liquid medium.

7. The developer of claim 1, wherein the charge controller is added in the ratio of approximately 1.0 to 80 percent by weight of the toner.

8. A liquid developer comprising:

a liquid medium; and toner dispersed in said liquid medium, wherein the volume average particle diameter (d50) of said toner particles is 0.5–5 micron and an air bubble ratio of said toner is from 2 to 20%.

9. The liquid developer of claim 8 wherein the air bubble ratio of said toner is from 8 to 17%.

10. The developer of claim 8 wherein 80% of the total volume of the toner is within the ±1 micron range of the volume average particle diameter (d50).

11. The developer of claim 8 wherein the toner comprises a resin and a coloring agent, and the coloring agent is added to the resin in an amount of 5 to 20 parts per 100 parts of the resin.

12. The developer of claim 8 wherein the liquid medium has a resistance from $10^{11}$ to $10^{16}$ ohm·cm.

13. The developer of claim 8 further comprises a copolymer of N-vinyl pyrolidone or dimethyl aminoethyl methacrylate and methacrylate having an alkyl group with 10 to 20 nitrogen atoms.

14. The developer of claim 8 further comprising a charge controller which is added in the ratio of approximately 0.1 to 5.0 percent by weight of the liquid medium.

15. The developer of claim 8, wherein the charge controller is added in the ratio of approximately 1.0 to 80 percent by weight of the toner.

16. A liquid developer comprising:

a liquid medium; and toner dispersed in said liquid medium, wherein the volume average particle diameter (d50) of said toner particles is 0.5 to micron, the difference in specific gravity between said toner and said liquid medium is 0.45 or less and an air bubble ratio of said toner is from 2 to 20%.

17. The developer of claim 16 wherein 80% of the total volume of the toner is within the ±1 micron range of the volume average particle diameter (d50).

18. The developer of claim 16 wherein the toner comprises a resin and a coloring agent, and the coloring agent is added to the resin in an amount of 5 to 20 parts per 100 parts of the resin.

19. The developer of claim 16 wherein the liquid medium has a resistance from $10^{11}$ to $10^{16}$ ohm·cm.

20. The developer of claim 16 further comprises a copolymer of N-vinyl pyrolidone or dimethyl aminoethyl methacrylate and methacrylate having an alkyl group with 10 to 20 nitrogen atoms.

21. The developer of claim 16 further comprising a charge controller which is added in the ratio of approximately 0.1 to 5.0 percent by weight of the liquid medium.

22. The developer of claim 16, wherein the charge controller is added in the ratio of approximately 1.0 to 80 percent by weight of the toner.

* * * * *